US010674811B2

(12) United States Patent
Mart et al.

(10) Patent No.: US 10,674,811 B2
(45) Date of Patent: Jun. 9, 2020

(54) CLEANING DEVICE

(71) Applicant: LAM LINE LLC, Chalfont, PA (US)

(72) Inventors: Laurie Mart, Chalfont, PA (US); Seth Beckley, Telford, PA (US)

(73) Assignee: LAM LINE LLC, Chalfont, PA (US)

( * ) Notice: Subject to any disclaimer, the term of this patent is extended or adjusted under 35 U.S.C. 154(b) by 87 days.

(21) Appl. No.: 16/036,251

(22) Filed: Jul. 16, 2018

(65) Prior Publication Data

US 2020/0015583 A1 Jan. 16, 2020

(51) Int. Cl.
*A46B 15/00* (2006.01)
*A47K 11/10* (2006.01)

(52) U.S. Cl.
CPC ..... *A46B 15/0065* (2013.01); *A47K 11/10* (2013.01); *A46B 2200/304* (2013.01)

(58) Field of Classification Search
CPC ..... A46B 15/0065; A46B 2200/304; A47K 11/10
See application file for complete search history.

(56) References Cited

U.S. PATENT DOCUMENTS 7,430,779 B1 * 10/2008 Garry ..... A46B 7/023 15/104.05
9,113,758 B1 * 8/2015 O'Brien ..... A47K 11/10
9,265,388 B2 * 2/2016 Yehuda ..... A47K 17/00
2001/0052353 A1 * 12/2001 Brumlik ..... A46B 11/0013 134/22.18
2015/0296972 A1 * 10/2015 Pender ..... A46B 13/04 15/22.1

FOREIGN PATENT DOCUMENTS

KR 200399549 Y1 * 10/2005
KR 101318028 B1 * 10/2013

OTHER PUBLICATIONS

KR200399549Y1—English Machine Translation (Year: 2003).*

* cited by examiner

*Primary Examiner* — Marc Carlson
(74) *Attorney, Agent, or Firm* — Howson & Howson LLP

(57) ABSTRACT

A cleaning device in the nature of a toilet brush has an external shaft with a gripping handle at one end and an array of bristles, forming a brush, at the opposite end. In internal shaft movable longitudinally within a space inside the external shaft has a chopping blade at one end, which can be made to protrude beyond the brush. The position of the internal shaft is controlled by manually gripping and moving an element that protrudes from the internal shaft though a longitudinal slot in the external shaft. The internal shaft can be locked in its retracted position or in its protruding position by a locking mechanism releasable by pushing inward on the protruding element.

3 Claims, 4 Drawing Sheets

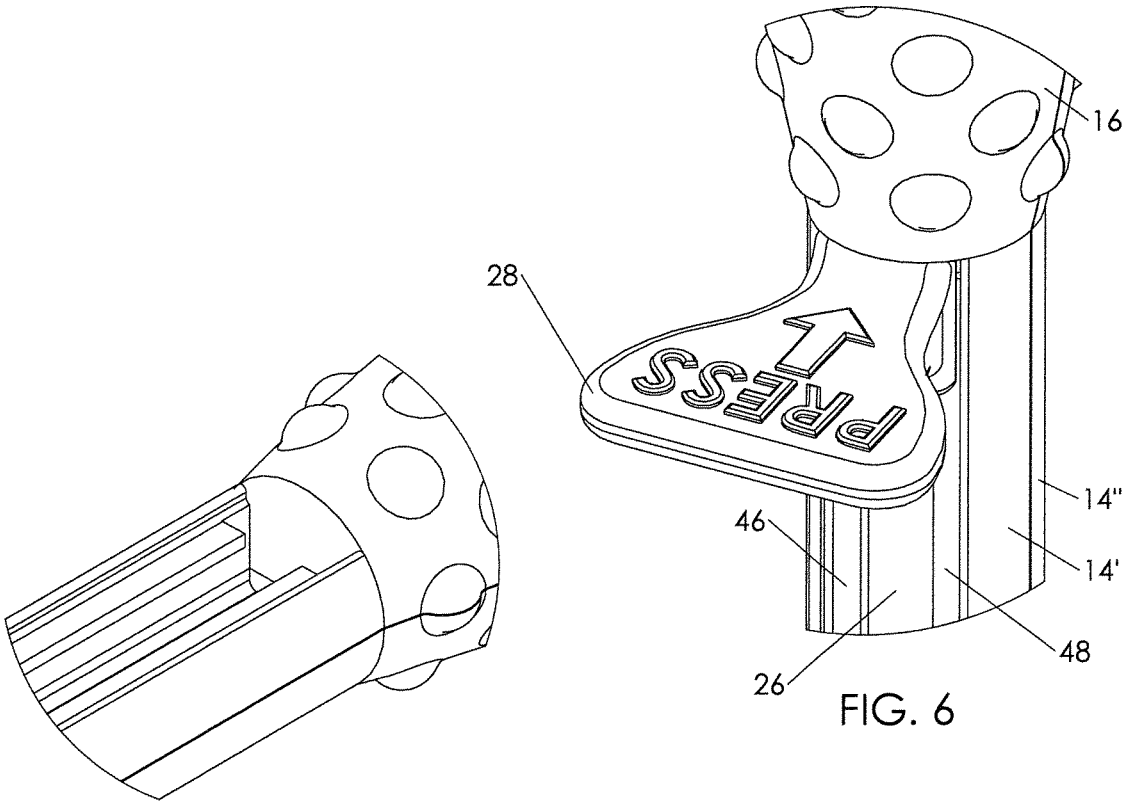
FIG. 6
FIG. 8
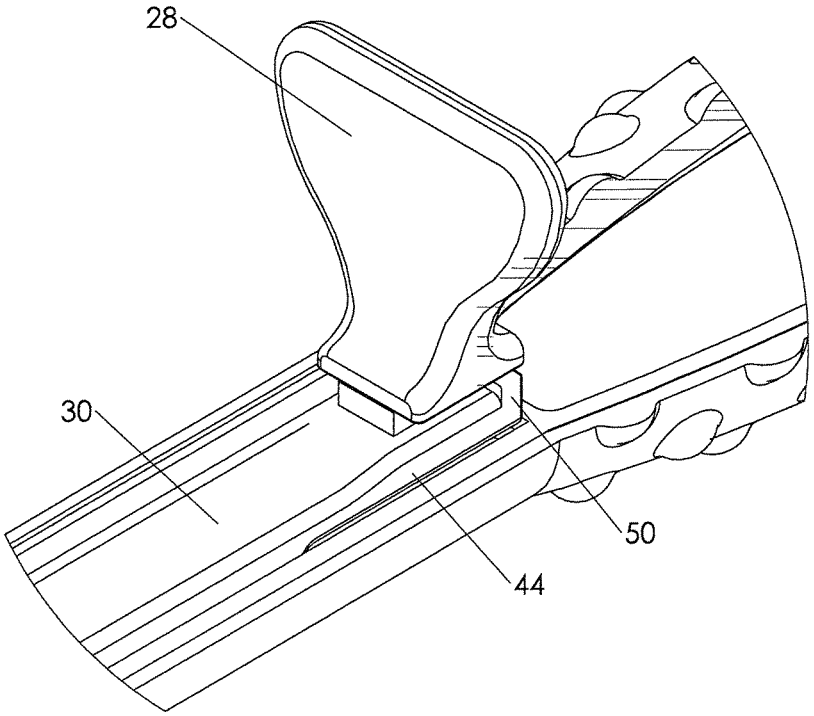
FIG. 7

CLEANING DEVICE

FIELD OF THE INVENTION

This invention relates to cleaning implements and particularly to a cleaning device for facilitating the cleaning of plumbing drains. The device has particular utility in cleaning toilets.

BACKGROUND OF THE INVENTION

A toilet bowl is typically composed of porcelain, although metal and other materials have been used. Regardless of the material, excrement, toilet paper and other debris tend to adhere to the interior of a toilet bowl, necessitating frequent cleaning. A toilet brush, consisting of a rigid, elongated rod, having a handle at one end and an array of bristles protruding from the opposite end, is ordinarily used for cleaning the bowl. The bristles are sufficiently rigid that they can dislodge most of the debris from the bowl's surface so that it can be removed to a drain pipe through the toilet's siphon by flushing.

At times, however, debris will adhere to the bowl in such a way that it cannot be easily dislodged by brushing. In addition, debris can sometimes accumulate in the drain opening at the bottom of the bowl, causing clogging and the risk of overflow. In the latter case, a conventional toilet brush is usually ineffective in removing the accumulated material, and must be set aside while other measures are utilized, such as the application of pressure or suction to the clogging material by means of a plunger, or the rapid pouring of a large quantity of water into the bowl from a bucket.

The use of conventional methods and devices to dislodge clogging material and to remove material adhering to the surface of the bowl can result in unsanitary contact with human excrement and bacteria-containing toilet water, and can also occasionally result in overflow.

There is a need for a more effective way to dislodge debris adhering to the interior surface of a toilet bowl and to remove debris that has accumulated in the drain opening at the bottom of the bowl, causing clogging.

SUMMARY OF THE INVENTION

Briefly, the invention is a cleaning device having both a brush and retractable chopping blade, in which the chopping blade can be extended and retracted, and in which, in the process of extending and retracting the chopping blade, the blade is cleaned by contact with bristles of the brush.

More specifically, the cleaning device of the invention comprises first and second elongated shafts that are movable relative to each other. The elongated first shaft has a manually grippable handle at a proximal end thereof and an array of bristles protruding from a portion adjacent a distal end thereof opposite from the proximal end. The second shaft is elongated in the direction of elongation of the first shaft, and is mounted to the first shaft for longitudinal sliding movement along the direction of elongation of the first shaft. The second shaft has a laterally extending, manually engageable, protrusion adjacent an end thereof nearest the proximal end of the first shaft and a chopping blade formed at an opposite end thereof. By manual movement of the protrusion, the chopping blade can be moved from a first location adjacent the bristles to a second location spaced in a distal direction from the bristles. The bristles protruding from a portion of the first shaft adjacent the distal end include bristles positioned to come into contact with, and to clean, the chopping blade when the chopping blade is moved reciprocally to and from the first location.

In a preferred embodiment, the cleaning device includes a releasable latch arranged to hold the second shaft in a fixed relationship to the first shaft such that the chopping blade is maintained in the first location, and alternatively to hold the second shaft in a fixed relationship to the first shaft such that the chopping blade is maintained in the second location.

The elongated first shaft is preferably formed with a longitudinally extending internal channel having a slot extending longitudinally along at least a part of the length of the first shaft. In this embodiment, the first shaft is formed with an opening in its distal end through which the second shaft can be extended. Thus, a part of the second shaft is located within the internal channel, and a part of said second shaft including the chopping blade can be extended in a distal direction beyond the distal end of the first shaft. The manually grippable protrusion is fixed to the second shaft and extends laterally outward from the internal channel through the slot, allowing a user to move the second shaft longitudinally relative to the first shaft by manually engaging and moving the protrusion.

In an embodiment in which the second shaft extends into a longitudinal channel formed in the first shaft, the releasable latch for holding the second shaft in a fixed relationship to the first shaft with the chopping blade at one of the above-mentioned first and second locations can comprise a shoulder formed as a part of the first shaft and a shoulder-engaging surface on a flexible, resilient part of the second shaft, arranged to engage the shoulder in order to maintain the fixed relationship between the first and second shafts. This engagement is releasable by manual operation of the protrusion to allow the second shaft to be moved longitudinally in the channel of the first shaft.

More particularly, in this embodiment, the cleaning device includes a releasable latching device arranged to hold the second shaft alternatively in a first fixed relationship to said first shaft such that the chopping blade is maintained in its first location, and in a second fixed relationship to the first shaft such that the chopping blade is maintained in its second location. The longitudinal slot has proximal and distal ends, and the releasable latching device comprises a first shoulder formed as a part of the first shaft and located adjacent the proximal end of the slot, and a second shoulder also formed as part of the first shaft and located adjacent the distal end of the slot. A resilient, flexible part of the second shaft adjacent the end thereof nearest the proximal end of the first shaft, includes a first shoulder-engaging surface releasably engageable with the first shoulder to lock the second shaft in a fixed relationship to the first shaft such that the chopping blade is maintained in its first location, i.e., adjacent the bristles, and a second shoulder-engaging surface releasably engageable with the second shoulder to lock the second shaft in a fixed relationship to the first shaft such that said chopping blade is maintained in its second, i.e., protruding location. The first and second shoulder-engaging surfaces of the flexible part are urged by the resilience of the flexible part of the second shaft in a direction such that they are respectively engageable with the first and second shoulders. The manually engageable protrusion is fixed to the flexible part and movable manually to disengage the shoulder-engaging surfaces from the shoulders and to cause the chopping blade to move from one to the other of the first and second locations.

When cleaning a toilet in which solid debris is adhering to the interior of the bowl, the chopping blade can be extended, locked in its extended position, and utilized to loosen the debris and break it up, if necessary, into a flushable condition. The chopping blade is then retracted and locked in its retracted condition, and the brush is used for cleaning the bowl. The chopping blade can be cleaned, either before or after using the brush to clean the toilet bowl, by repeatedly extending and retracting the blade and thereby causing it to move into and out of contact with bristles of the brush.

While the cleaning device described herein is primarily intended for use in cleaning toilets, the device and modified versions can be utilized in the cleaning and maintenance of drains of various kinds, such as drains in basins, shower and bathtub drains, and floor drains.

BRIEF DESCRIPTION OF THE DRAWINGS

FIG. 6 is an enlarged fragmentary perspective view illustrating details of the manually engageable protrusion;

FIG. 7 is an enlarged fragmentary perspective view illustrating further details of the manually engageable protrusion;

FIG. 8 is an enlarged fragmentary perspective view showing details of a shoulder structure for retaining the inner shaft in the retracted condition;

DETAILED DESCRIPTION OF THE PREFERRED EMBODIMENTS

Figure 1:
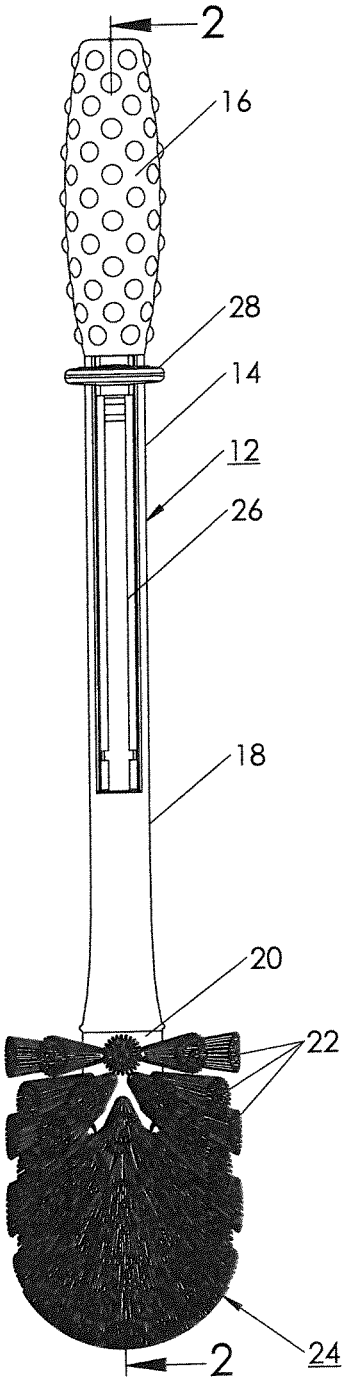
FIG. 1 is a front elevational view of a cleaning device in accordance with the invention.

As shown in FIG. 1, the cleaning device 12 includes an elongated shaft 14 having a manually grippable handle 16 at a proximal end of the shaft. The handle is preferably molded as a unitary part of the shaft 14, but as an alternative, the handle can be a separately formed element, attached to the shaft 14 by suitable means, e.g., an adhesive, mating threads on the handle element and shaft, or a separate fastener. The external surface of the handle can be formed with an array of bumps as shown, or with other surface features designed to prevent the handle from slipping in the user's hand.

The exterior of the intermediate part 18 of the shaft 14 preferably has a circular cross-section. The opposite, i.e., distal, end portion 20 of the shaft is preferably also formed as a unit with the intermediate part 18 of the shaft, and has a circular exterior cross-sectional shape, with a diameter larger than that of the intermediate part 18. Groups 22 of flexible bristles protrude from the distal end 20 forming a brush 24. Ends of bristles in each group are embedded in the enlarged distal end of the shaft, preferably in such a way that the bristles of the groups nearest the handle protrude in a generally radial direction relative to a longitudinal axis of the shaft, and, proceeding toward the distal end of the shaft, the direction of the bristles gradually approaches the direction of the longitudinal axis.

The intermediate part of shaft 14, between the handle 16 and the brush 24, is formed with a longitudinally elongated slot 26 that extends from a location adjacent the handle to an intermediate location between the handle the brush. The slot accommodates a manually engageable protrusion 28, which is used to control the movement of a second shaft located, and slidable longitudinally, in an internal channel inside the shaft 14. The second shaft has a chopping blade formed at one of its ends.

Figure 2:
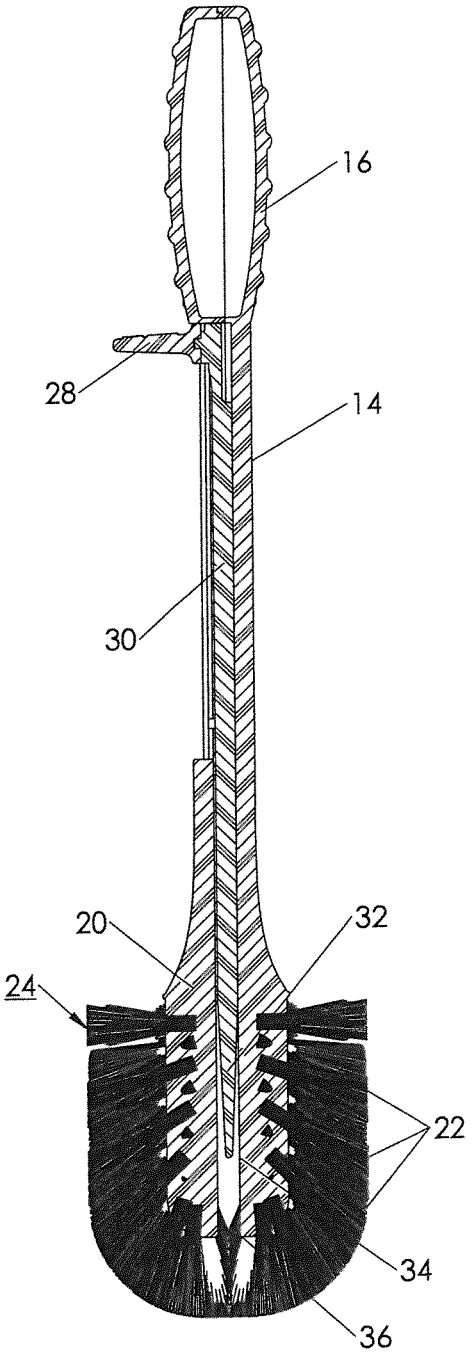
FIG. 2 is a cross-sectional view taken on section plane 2-2 in FIG. 1.

As shown in FIG. 2, the protrusion 28 is fixed to the second shaft 30 at a location at or near the proximal end of the second shaft, and the chopping blade 32 is formed at the distal end of shaft 30. In FIG. 2, the chopping blade is shown in its retracted condition in the internal channel 34 in the shaft 14. The internal channel 34 has an opening 36 at its distal end, allowing the shaft 30 to be extended beyond the distal end of the shaft 14 so that the chopping blade 32 can be moved beyond the brush 24.

Figure 9:
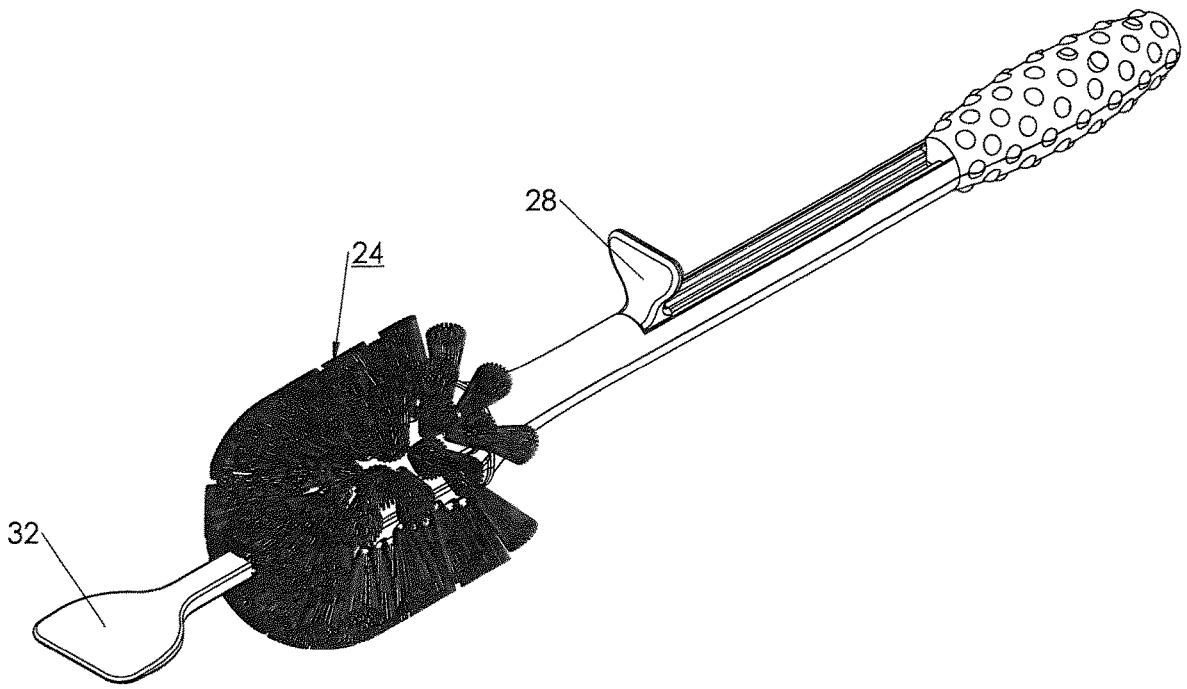
FIG. 9 is a perspective view of the cleaning device with the inner shaft extended.

As shown in FIG. 2, some of the bristles that extend from the enlarged distal end portion 20 of the shaft 14 are positioned to come into contact with, and to clean, the chopping blade 32 when the chopping blade is moved reciprocally between the location in which it is depicted in FIG. 2 and an extended location as shown in FIG. 9.

Figure 3:
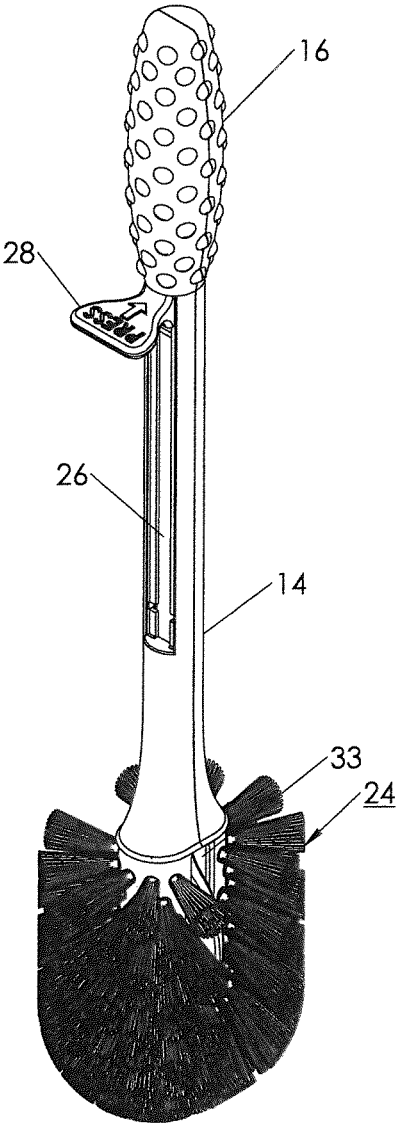
FIG. 3 is a perspective view of the cleaning device with the inner shaft retracted.
Figure 4:
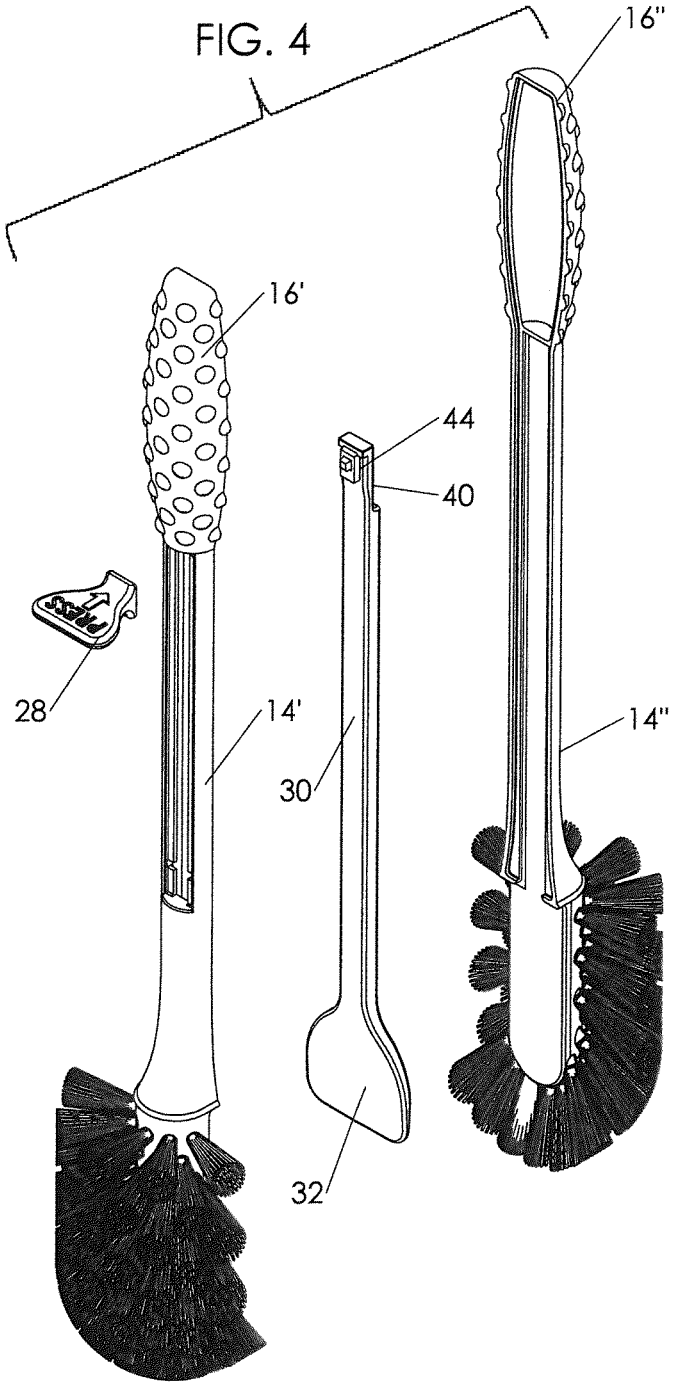
FIG. 4 is an exploded perspective view of the cleaning device, showing the external shaft in two parts, the internal shaft with the chopping blade at one end thereof, and the manually engageable protrusion for unlocking, and for extending and retracting, the internal shaft.

FIG. 3 shows the cleaning device in an assembled condition, and FIG. 4 shows the principal components in the same orientation as in FIG. 4, but in an exploded view. The handle 16 and shaft 14 are composed of similar parts, namely handle parts 16' and 16" and shaft parts 14' and 14", which are secured to each other in an assembly process either by a fusion process or by the use of a suitable adhesive. The second shaft 30 preferably has a generally rectangular cross-section, and the parts 14' and 14" of the first shaft 14 are shaped so that when they are brought together the internal channel 34 conforms to the cross-sectional shape of shaft 30, allowing shaft 30 to slide longitudinally but preventing rotation and lateral translational movement of shaft 30.

As shown in FIG. 4, the chopping blade 32 is wider than shaft 30. The enlarged distal end portion 20 of the shaft 14 is formed in such a way that longitudinal slot-shaped openings are provided on opposite sides to accommodate the width of the chopping blade. One such opening, opening 33, is shown in FIG. 3.

Figure 5:
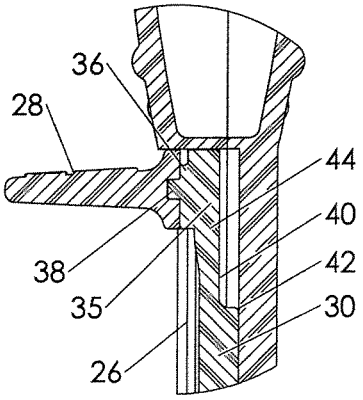
FIG. 5 is an enlarged fragmentary sectional view illustrating details of the mechanism by which the internal shaft is locked in its retracted position.

As shown in FIG. 5, protrusion 28 is secured to an extension 35 formed on the proximal end of shaft 30. The extension 35 includes a portion 36 that can extend through, or part of the way through, slot 26, and the protrusion 28 is secured to portion 36 by suitable means such as fusion or a suitable adhesive, and the connection of the protrusion 28 to portion 36 is preferably reinforced by the engagement of a tab 38 on portion 36 with a conforming depression on protrusion 28.

As shown in FIGS. 2, 4 and 5, the part of shaft 30 near the proximal end is formed with a recess 40 which extends from the proximal end to an intermediate location 42. Because of the recess, a portion 44 of the shaft 30 adjacent the recess is narrower and more flexible than the lower part of shaft 30, and can be bent into the space formed by the recess by manually pushing on protrusion 28. Resilience of the shaft material causes the portion 44 to resume the shape depicted in FIG. 5 when pressure on the protrusion is released. The shafts can be molded from a variety of materials such as polyamide resins, polypropylene, or various polyester resins.

FIG. 6 shows that the slot 26 is a space between two opposed longitudinally extending ribs 46 and 48, which are unitary parts of shaft part 14'. Flexible portion 44 of shaft 30, which is wider than slot 26, is formed with a forwardly projecting locking tab 50, shown in FIG. 7. This locking tab extends across the width of flexible portion 44, and end portions of the locking tab are located so that they can engage shoulders 52 and 54 formed at the proximal ends of ribs 46 and 48 as shown in FIG. 8, thereby locking shaft 30 in the retracted position as depicted in FIGS. 3, 6 and 7. Locking tab 50 does not need to be continuous across the full width of portion 44, and alternative locking mechanisms can be used. For example, the locking tab can be composed of two parts, one engageable with shoulder 52 and the other engageable with shoulder 54.

The engagement of the locking tab 50 with shoulders 52 and 54 can be released by pushing inward on protrusion 28, and shaft 30 can then be moved longitudinally to cause the chopping blade 32 to protrude as shown in FIG. 9. When the shaft 30 is in its protruded condition, the resilience of portion 44 will cause locking tab 50 to move into notches 56 and 58, shown in FIG. 10. These notches are formed in ribs 46 and 48 respectively. These notches are laterally opposed to each other, and located adjacent the distal ends of ribs 46 and 48. Engagement of tab 50 with shoulders 60 and 62 in the notches maintains the shaft 30 in its protruding condition until it is released by pushing inward on protrusion 28.

Figure 10:
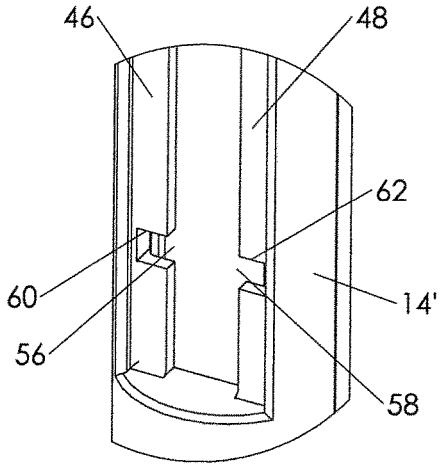
FIG. 10 is an enlarged perspective view illustrating the shoulder structure for retaining the inner shaft in an extended condition.

A user can operate the cleaning device as a conventional brush, with the chopping blade retracted, and when the chopping blade 32 is needed to dislodge debris, it can be extended by manually grasping and pressing inward on protrusion 28, and then moving protrusion 28 in the distal direction until the shaft 30 is locked in its protruding position by engagement of tab 50 (FIG. 7) with the shoulders 60 and 62 in notches 56 and 58 (FIG. 10). Upon completion of the dislodgment of debris, the user can grasp and press inward on protrusion 28, thereby releasing the shaft 30 for movement in the proximal direction. Then, by moving protrusion 28 back and forth longitudinally through the range between the locations in which locking engagement takes place, the user can cause the bristles that protrude form the distal end of the shaft 14 to clean the blade 32.

The cleaning device described and shown in the drawings is a currently preferred embodiment. Many modifications can be made to the device, however. For example, the internal shaft in which the chopping blade is a part can have a cross-sectional shape other than rectangular. The latching mechanism for holding the internal shaft in its retracted and protruding positions can include flexible elements that are secured to, but not unitary with, the internal shaft. Moreover, in an alternative version, it is possible for the manually operable protrusion that controls the position of the chopping blade to be unitary with the internal shaft. Numerous other modifications can, of course be made without departing from the scope of the invention.

What is claimed is:

1. A cleaning device for plumbing fixtures comprising:

an elongated first shaft having a manually grippable handle at a proximal end thereof and an array of bristles protruding from a portion of the first shaft adjacent a distal end thereof opposite from said proximal end; and a second shaft elongated in the direction of elongation of the first shaft, said second shaft being mounted to said first shaft for longitudinal sliding movement along said direction of elongation, the second shaft having a manually engageable protrusion adjacent an end thereof nearest said proximal end of the first shaft and having a chopping blade formed at an opposite end thereof, the chopping blade being movable, by manual movement of said protrusion, from a first location adjacent said bristles to a second location spaced in a distal direction from said bristles;

wherein said bristles include bristles positioned to come into contact with, and to clean, said chopping blade when the chopping blade is moved reciprocally to and from said first location, wherein said elongated first shaft is formed with a longitudinally extending internal channel having an slot extending longitudinally along at least a part of the length of said first shaft, wherein said elongated first shaft is formed with an opening in said distal end thereof, wherein said second shaft extends through said opening whereby a part of said second shaft is located within said internal channel and a part of said second shaft including said chopping blade extends in a distal direction beyond the distal end of said first shaft, wherein said manually engageable protrusion extends outward from said internal channel through said slot, whereby a user can move said second shaft longitudinally relative to said first shaft by manually engaging and moving said manually engageable protrusion, the cleaning device further including a releasable latch arranged to hold the second shaft in a fixed relationship to said first shaft such that said chopping blade is maintained in said first location;

wherein said slot has proximal and distal ends; and wherein said releasable latch comprises:

a shoulder formed as a part of said first shaft, said shoulder being located adjacent the proximal end of said slot; and a resilient, flexible part of said second shaft adjacent said end thereof nearest said proximal end of the first shaft, said resilient flexible part including a shoulder-engaging surface releasably engageable with said shoulder to lock said second shaft in a fixed relationship to said first shaft such that said chopping blade is maintained in said first location, said shoulder-engaging surface of said flexible part being urged by the resilience of said flexible part in a direction such that it is engageable with said shoulder; and wherein said manually engageable protrusion is fixed to said flexible part and movable manually to disengage said shoulder-engaging surface from said shoulder and to cause said chopping blade to move toward said second location.

2. A cleaning device for plumbing fixtures comprising:

an elongated first shaft having a manually grippable handle at a proximal end thereof and an array of bristles protruding from a portion of the first shaft adjacent a distal end thereof opposite from said proximal end; and a second shaft elongated in the direction of elongation of the first shaft, said second shaft being mounted to said first shaft for longitudinal sliding movement along said direction of elongation, the second shaft having a manually engageable protrusion adjacent an end thereof nearest said proximal end of the first shaft and having a chopping blade formed at an opposite end thereof, the chopping blade being movable, by manual movement of said protrusion, from a first location adjacent said bristles to a second location spaced in a distal direction from said bristles;

wherein said bristles include bristles positioned to come into contact with, and to clean, said chopping blade when the chopping blade is moved reciprocally to and from said first location, wherein said elongated first shaft is formed with a longitudinally extending internal channel having an slot extending longitudinally along at least a part of the length of said first shaft, wherein said elongated first shaft is formed with an opening in said distal end thereof, wherein said second shaft extends through said opening whereby a part of said second shaft is located within said internal channel and a part of said second shaft including said chopping blade extends in a distal direction beyond the distal end of said first shaft, wherein said manually engageable protrusion extends outward from said internal channel through said slot, whereby a user can move said second shaft longitudinally relative to said first shaft by manually engaging and moving said manually engageable protrusion;

the cleaning device further including a releasable latch arranged to hold the second shaft in a fixed relationship to said first shaft such that said chopping blade is maintained in said second location; wherein said slot has proximal and distal ends; and wherein said releasable latch comprises:

a shoulder formed as a part of said first shaft, said shoulder being located adjacent the distal end of said slot; and a resilient, flexible part of said second shaft adjacent said end thereof nearest said proximal end of the first shaft, said resilient flexible part including a shoulder-engaging surface releasably engageable with said shoulder to lock said second shaft in a fixed relationship to said first shaft such that said chopping blade is maintained in said second location, said shoulder-engaging surface of said flexible part being urged by the resilience of said flexible part in a direction such that it is engageable with said shoulder; and wherein said manually engageable protrusion is fixed to said flexible part and movable manually to disengage said shoulder-engaging surface from said shoulder and to cause said chopping blade to move toward said first location.

3. A cleaning device for plumbing fixtures comprising:

an elongated first shaft having a manually grippable handle at a proximal end thereof and an array of bristles protruding from a portion of the first shaft adjacent a distal end thereof opposite from said proximal end; and a second shaft elongated in the direction of elongation of the first shaft, said second shaft being mounted to said first shaft for longitudinal sliding movement along said direction of elongation, the second shaft having a manually engageable protrusion adjacent an end thereof nearest said proximal end of the first shaft and having a chopping blade formed at an opposite end thereof, the chopping blade being movable, by manual movement of said protrusion, from a first location adjacent said bristles to a second location spaced in a distal direction from said bristles;

wherein said bristles include bristles positioned to come into contact with, and to clean, said chopping blade when the chopping blade is moved reciprocally to and from said first location, wherein said elongated first shaft is formed with a longitudinally extending internal channel having an slot extending longitudinally along at least a part of the length of said first shaft, wherein said elongated first shaft is formed with an opening in said distal end thereof, wherein said second shaft extends through said opening whereby a part of said second shaft is located within said internal channel and a part of said second shaft including said chopping blade extends in a distal direction beyond the distal end of said first shaft, wherein said manually engageable protrusion extends outward from said internal channel through said slot, whereby a user can move said second shaft longitudinally relative to said first shaft by manually engaging and moving said manually engageable protrusion;

the cleaning device further including a releasable latch mechanism arranged to hold the second shaft alternatively in a first fixed relationship to said first shaft such that said chopping blade is maintained in said first location and in a second fixed relationship to said first shaft such that said chopping blade is maintained in said second location; wherein said slot has proximal and distal ends; and wherein said releasable latch comprises:

a first shoulder formed as a part of said first shaft, said first shoulder being located adjacent the proximal end of said slot;

a second shoulder formed as part of said first shaft, said second shoulder being located adjacent the distal end of said slot; and a resilient, flexible part of said second shaft adjacent said end thereof nearest said proximal end of the first shaft, said resilient flexible part including a first shoulder-engaging surface releasably engageable with said first shoulder to lock said second shaft in a fixed relationship to said first shaft such that said chopping blade is maintained in said first location, and a second shoulder-engaging surface releasably engageable with said second shoulder to lock said second shaft in a fixed relationship to said first shaft such that said chopping blade is maintained in said second location, said first and second shoulder-engaging surfaces of said flexible part being urged by the resilience of said flexible part in a direction such that they are respectively engageable with said first and second shoulders; and wherein said manually engageable protrusion is fixed to said flexible part and movable manually to disengage said shoulder-engaging surfaces from said shoulders and to cause said chopping blade to move from one to the other of said first and second locations.

* * * * *